United States Patent [19]

Ishii

[11] Patent Number: 4,922,819

[45] Date of Patent: May 8, 1990

[54] IMAGE ADJUSTING APPARATUS FOR MULTI-COLOR PRINTING MACHINE

[75] Inventor: Koji Ishii, Fuchu, Japan

[73] Assignee: Ryobi Ltd., Hiroshima, Japan

[21] Appl. No.: 269,094

[22] Filed: Nov. 9, 1988

[30] Foreign Application Priority Data

Nov. 9, 1987 [JP] Japan ..... 62-284061

[51] Int. Cl.[5] ..... B41F 21/10; B41F 7/10

[52] U.S. Cl. ..... 101/177; 101/232; 101/248

[58] Field of Search ..... 101/232, 248, 181, 246, 101/409, 410, 411, 177; 271/314, 82, 109, 69

[56] References Cited

U.S. PATENT DOCUMENTS

| | | | |
|---|---|---|---|
| 2,539,068 | 1/1951 | Funk | 101/248 |
| 2,660,115 | 11/1953 | Ras | 101/248 |
| 3,413,920 | 12/1968 | Kaneko et al. | 101/248 |
| 4,457,231 | 7/1984 | Kawaguchi | 101/248 |

*Primary Examiner*—J. Reed Fisher

*Attorney, Agent, or Firm*—Sughrue, Mion, Zinn, Macpeak & Seas

[57] ABSTRACT

In a multi-color printing machine, any positional error of a image is corrected by a longitudinal image displacement correcting mechanism and/or a diagonal image adjusting mechanism. In the former mechanism, the phase of a paper-feed cylinder relative to an impression cylinder is changed by utilizing the principle of a helical gear. In the latter mechanism, the paper-feed cylinder is tilted or twisted relative to the impression cylinder.

14 Claims, 6 Drawing Sheets

IMAGE ADJUSTING APPARATUS FOR MULTI-COLOR PRINTING MACHINE

CROSS-REFERENCE TO RELATED APPLICATIONS

This application is related to our commonly assigned copending U.S. Pat. application, Ser. No. 024,215, filed Mar. 1987. Further, another copending U.S. Pat. application Ser. No 269,846 filed on Nov. 10, 1988, now Pat. No. 4,860,651, has been filed on (corresponding to Japanese Utility Model Application No. 62-174175).

BACKGROUND OF THE INVENTION

The present invention relates to a multi-color printing machine, and more particularly, to an image adjusting apparatus for correcting a longitudinal image displacement and, if any, for correcting a diagonal image to be printed in a multi-color printing machine.

Conventionally, in four-color printing by means of a two-color offset printing machine, each of first-color and second-color images must be registered with a paper before registering the second-color image with the first-color image. Further, for printing third and fourth color images, a third image carried by a plate cylinder must be adjusted and thereafter, a forth image carried by another plate cylinder must be adjusted. That is, a longitudinal image displacement and/or a skew due to an error in plate making, a twist in plate mounting, or the like should be corrected for each of subsequent third-color and fourth-color images. Therefore, image adjusting operation is intricate, and requires considerable labour and time.

Further, according to a conventional apparatus, it is impossible to adjust image in longitudinal direction with respect to the paper as well as to adjust image in oblique direction of the paper. Therefore, complete adjustment between the master plate and the paper cannot be conducted with respect to various directions.

SUMMARY OF THE INVENTION

It is therefore an object of the present invention to provide an image adjusting apparatus for correcting color slip in a longitudinal direction of a paper in a multi-color printing machine by simply adjusting a paper-feed cylinder without any adjustment of a master-plate cylinder.

Another object of the invention is to provide an image adjusting apparatus, for multi-color printing machines, which is simple in construction and guarantees easy and highly precise compensation of a longitudinal image displacement of an image to be printed.

Still another object of this invention is to provide such image adjusting apparatus capable of performing adjustment of longitudinal image displacement as well as performing adjustment of distortion or diagonal image by merely moving a paper feed cylinder.

Still another object of this invention is to provide such apparatus capable of performing four color printing wherein third and fourth color images carrried on plate cylinders are merely adjusted in longitudinal direction of the paper, yet automatically obtaining image conformace of the third and fourth color images relative to already printed first and second color images.

Still another object of this invention is to provide such apparatus capable of performing a single color image printing wherein an image adjustment of the plate cylinder can be eliminated and instead, only the paper feed cylinder is controlledly operated for adjusting longitudinal image displacement.

Still another object of this invention is to provide such single color image printing machine in which such longitudinal image displacement is adjustable even during printing operation of the machine.

According to the present invention, there is provided an image adjusting apparatus for adjusting a paper position with respect to an original image in a multi-color printing machine, comprising: a pair of first and second frames; an impression cylinder having a first shaft rotatably supported on the first and second frames; a paper-feed cylinder for feeding the paper to the impression cylinder, the paper-feed cylinder having a second shaft rotatably and axially slidably supported at one and another end portions by the first and second frames; a moving means for moving said second shaft in axial direction thereof, the moving means being operably connected to the second shaft of the paper-feed cylinder; and a phase changing mechanism provided between the first and second shafts for rotating the second shaft in response to axial movement of the second shaft so as to change a peripheral position of the paper-feed cylinder relative to the impression cylinder. Accordingly, longitudinal image displacement relative to the paper is adjustable.

Many other advantages, features and additional objects of the present invention will become manifest to those versed in the art upon making reference to the following detailed description and the accompanying drawings in which certain preferred structural embodiments incorporating the principles of the present invention are shown by way of illustrative example.

DETAILED DESCRIPTION OF THE PREFERRED EMBODIMENTS

An embodiment of this invention will be described with reference to accompanying drawings.

Figure 2:
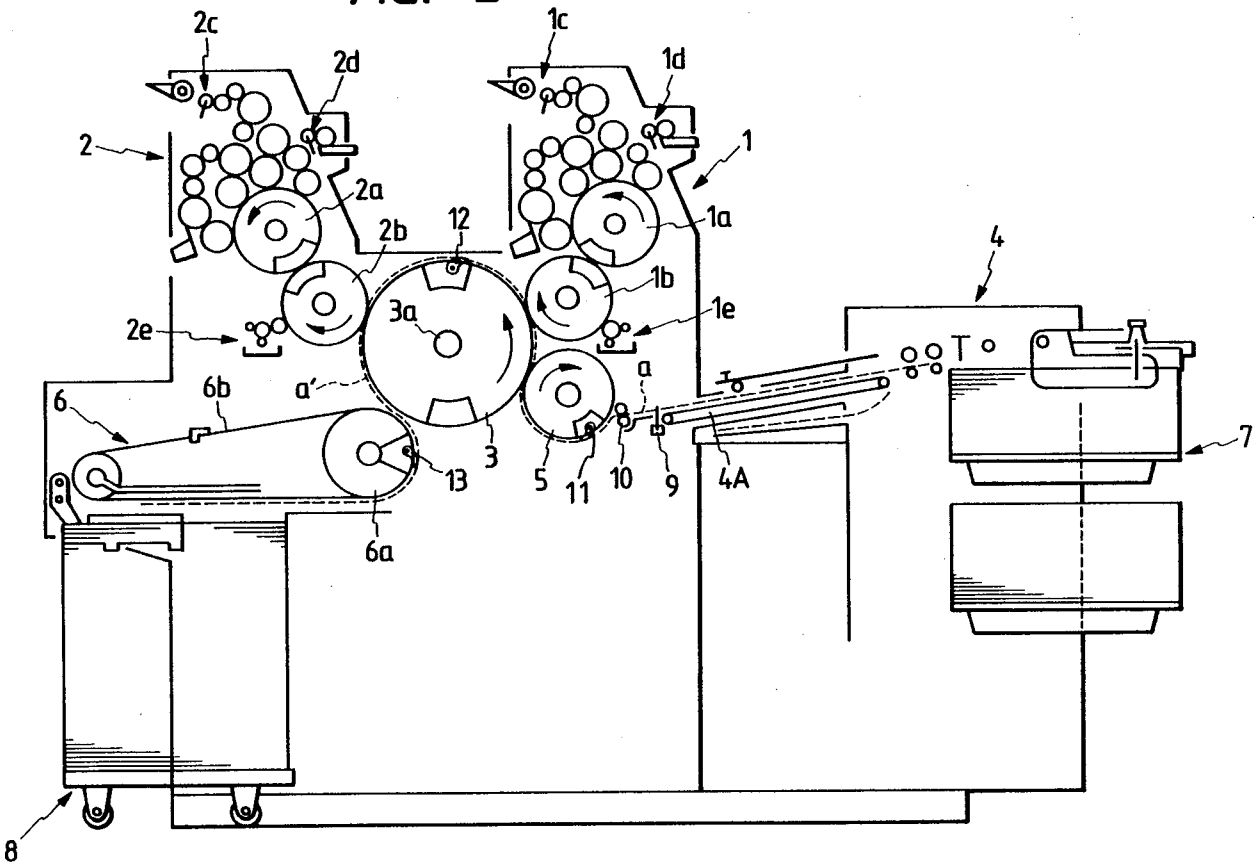
FIG. 2 is a schematic side elevational view showing a two-color offset printing press according to the present invention.

FIG. 2 illustrates a two-color offset printing machine (hereinafter simply referred to as "printing machine"). The printing machine generally includes a first printing unit 1, a second printing unit 2, a base impression cylinder 3 serving also as a transfer drum for the second printing unit 2, a feeder 4, a paper-feed cylinder 5, a delivery unit 6, a paper supply table 7, and a paper discharge table 8. The feeder 4 includes a paper feeding means 4A, and between the paper-feed cylinder 5 and an outlet end of the paper feeding means 4A, a pair of paper insertion rollers 10 are provided. Such general structure is the same as that in the copending U.S. Pat. application Ser. No. 024,215, now Pat. No. 4,777,876.

The first and second printing units and 2 have identical constructions with each other which include various corresponding cylinders having equal diameter to each other. More specifically, these units and 2 are respectively composed of plate cylinders 1*a* and 2*a*, blanket cylinders 1*b* and 2*b*, ink supply sections 1*c* and 2*c*, water supply sections 1*d* and 2*d*, and blanket cleaning sections 1*e* and 2*e*.

A registering means 9 is provided at an outlet end of the paper delivery means 4A so as to align or preregistor the paper "a". Further, a first gripper 11 is provided at the paper-feed cylinder 5 of the first printing unit 1 for gripping the paper "a" in its aligned orientation fed from the paper feeding means 4A. The base impression cylinder 3 has a second gripper 12 for gripping the paper "a" fed from the paper feed cylinder 5.

The delivery unit 6 has a paper discharge cylinder provided with a sprocket 6*a* adjacent to the base impression cylinder 3. An endless chain 6*b* is mounted over the sprocket 6*a*, and a third gripper 13 is provided at the chain 6*b* for holding and discharging the printed sheet a' fed from the base impression cylinder 3. The sprocket 6*a* and the paper-feed cylinder 5 have the diameters the same as those of the plate cylinders 1*a*, 2*a* and the blanket cylinders 1*b*, 2*b* of each of the first and second printing units 1, 2. Further, the diameters of the sprocket 6*a* and the paper-feed cylinder 5 is half the diameter of the base impression cylinder 3.

In operation, the paper "a" having been delivered from the feeder 4 is subjected to pre-registration by the registering means 9, and the paper "a" is then fed to the paper-feed cylinder 5 through the paper feeding means 4A and the paper insertion rollers 10. Upon arrival at the paper-feed cylinder 5, the leading edge of the paper "a" is gripped by the first gripper 12, and thence the paper "a" as gripped is transferred to the base impression cylinder 3 and is gripped by the second gripper 12. During that time, the paper "a" is printed with a first color at the first printing unit 1. The paper "a" is further fed to the second printing unit 2 where the paper "a" is additionally printed with a second color. The twice printed paper a' is discharged onto the chain 6*b* and is gripped by the third gripper 13. The paper a' is then transferred onto the paper discharge stand 8. Thus a cycle of two-color printing has been completed.

Figure 5:
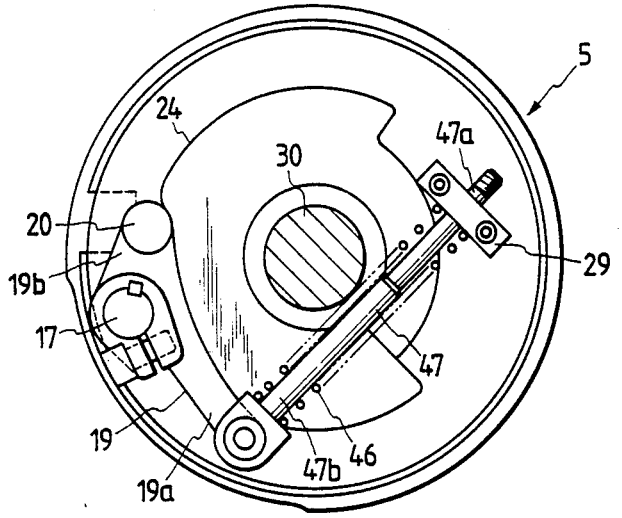
FIG. 5 is a cross-sectional view taken along the line V—V in FIG. 1.
Figure 6:
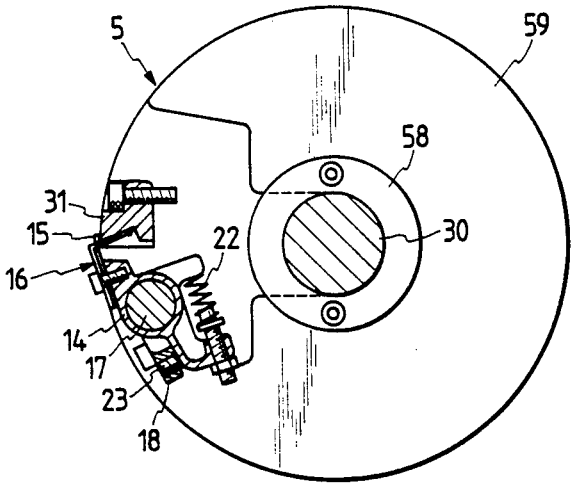
FIG. 6 is a cross-sectional view taken along the line VI—VI in FIG. 1.

As shown in FIGS. 5 and 6, a plurality of grip holders 14 are rotatably mounted on a grip shaft 17 extending in parallel with the shaft 30 of the paper-feed cylinder 5, and their axial movements are prevented individually by a plurality of retainer 18 fixedly mounted on the grip shaft 17 by means of screw bolts 23 at suitable axial intervals. A grip 15 and a stop 16 are fixed to each of the grip holder 14.

Figure 1:
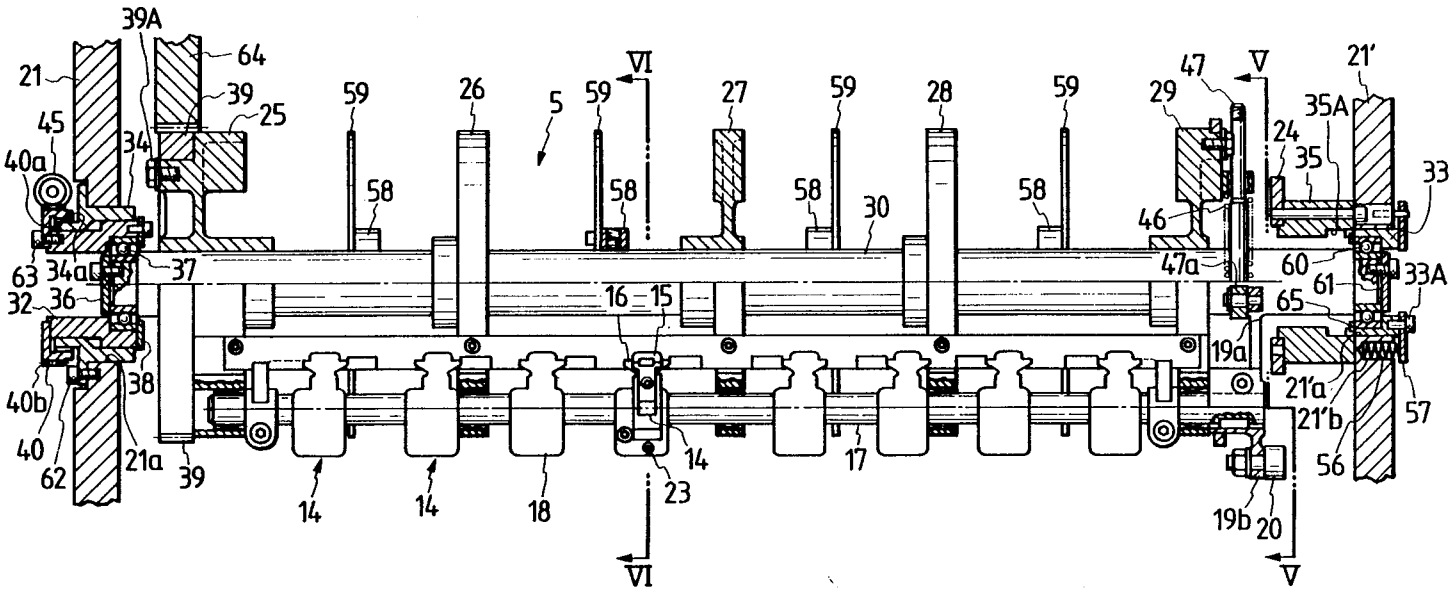
FIG. 1 is a side view partly cross-sectioned showing a longitudinal image displacement adjusting apparatus incorporated in an offset printing press according to the present invention.

As shown in FIGS. 1, 5 and 6, a wheel 29 is fixedly provided at the shaft 30, and a cam lever 19 is fixed to one end of the grip shaft 17. One end 19*a* of the cam lever 19 is pivotally connected to one end 47*b* of a spring guide 47, and a coil spring 46 is disposed over the spring guide 47. Another end 47*a* of the spring guide 47 is slidably supported on the wheel 29. A cam follower 20 is rotatably connected to another end 19*b* of the cam lever 19 The cam follower 20 is engageable with a cam 24 secured to a frame 21' through a shaft holder 35. The shaft holder 35 is pivotally supported on the frame 21' by a bolt, and is formed with a slide guide surface 35A. Upon movement of the cam follower 20 along the cam surface of the cam 24, the grip shaft 17 is rotated about its axis in normal direction against the biasing force of the spring 46 or in the reverse direction by the biasing force. Therefore, the individual grip holder 14 is pivotally moved about the axis of the grip shaft 17 by the corresponding retainer 18 via a spring 22 (FIG. 6) and the screw bolt 23 (FIGS. 1 and 6), thus closing and opening the individual grip 15.

The grip shaft 17, as shown in FIG. 1, is rotatably supported on a plurality of wheels 25, 26, 27, 28, 29 fixed to the shaft 30 of the paper-feed cylinder 5 at suitable axial intervals, and is directed in parallel with the shaft 30. A grip receiving member 31 (FIGS. 1 and 6) is fixedly supported by each of the wheels 25 through 29.

A pair of plates 59, 59 (FIGS. 1 and 6) fixed to the shaft 30 of the paper-feed cylinder 5 via a pair of collars 58, 58, respectively, serves as a paper guide.

A longitudinal image displacement adjusting apparatus according to this invention will now be described in detail. Opposite ends of the shaft 30 of the paper-feed cylinder 5 are rotatably supported by first and second bearings 37, 60, as shown in FIG. 1. The first and second bearings 37, 60 are supported by the frame 21 and the frame 21', respectively, and are held in positions by bearing retainers 36, 61, respectively. More specifically, the bearing retainer 36 is fixedly secured to one end face of the shaft 30 and secures an inner ring of the first bearing 37, and the bearing retainer 61 is fixedly secured to another end face of the shaft 30 and secures an inner ring of the second bearing 60. Therefore, these bearing retainers prevent the first and second bearings 37 and 60 from their axial displacements relative to the shaft 30.

A first inner sleeve member 32 is disposed over the first bearing 37 and a first bearing stop 38 is fixedly secured to the first inner sleeve member 32 so as to support an outer ring of the first bearing 37. Further, a second inner sleeve member 33 is disposed over the second bearing 60 and a second bearing stop 65 is fixedly secured to the second inner sleeve member 33 so as to support an outer ring of the second bearing 60. Therefore, the axial positional relationship among the first bearing 37, the first bearing retainer 36 and the first bearing stop 38 is maintained unchanged. The same is true with respect to the relationship among the second bearing 60, the second bearing retainer 61 and the second bearing stop 65.

The first inner sleeve 32 is axially slidably received in a first outer sleeve 34 received in a mounting opening 21*a* formed in the first frame 21 and fixed to the latter by a screw 62. The slide guide surface 35A of the shaft holder 35 is flush with the opening 21*a*. The first outer sleeve 34 has an outer peripheral surface formed with a male thread 34*a*. On the other hand, the second inner sleeve 33 is axially slidably received in a mounting opening 21'*a* formed in the second frame 21'. The second inner sleeve 33 is also slidable on the slide guide surface 35A of the shaft holder 35. Consequently the paper-feed cylinder 5 is rotatable together with the rotation of the shaft 30 with respect to the first and second frames 21, 21', and also is axially slidable together with the first and second inner sleeves 32, 33 with respect to the first and second frames 21, 21'.

A first helical gear wheel 40 is fixed to an outer planar end of the first inner sleeve 32 by a screw 63. The helical gear 40 is of cup-shaped construction, and its bottom wall is secured to the first inner sleeve 32. The helical gear wheel 40 is provided with an inner peripheral surface formed with a female thread 40*a* threadingly engageable with the male thread 34*a*. The gear 40 is also provided with an outer peripheral surface formed with a male thread 40*b*. When the helical gear wheel 40 is rotated in a manner described below, the first inner sleeve 32 is rotatingly moved in axial direction relative to the outer sleeve 34 because of the meshing engagement between the gear tenths 34*b* and 40*a*, to thus cause the shaft 30 and hence the paper-feed cylinder 5 to be axially moved together with the first bearing 37.

Further, a second helical gear 64 for the purpose of power transmission is fixed to the base impression cylinder 3, and a third helical gear 39 is fixed to the wheel 25 of the paper-feed cylinder 5 by way of a bolt 39A. The third helical gear 39 is meshedly engaged with the second helical gear 64. Since the paper-feed cylinder 5 is movable in axial direction thereof relative to the base impression cylinder 3, the phase of the paper-feed cylinder 5 relative to the base impression cylinder 3 is changeable because of a twist angle of the second and third helical gears 64, 39. With this phase change, the position to which the paper a is to be fed, is moved forwardly or backwardly so that the paper a is gripped by the second gripper 12 on the base impression cylinder 3 in such advanced or retracted posture. Accordingly, any longitudinal displacement or divergence of an image to be printed can be corrected.

Figure 3:
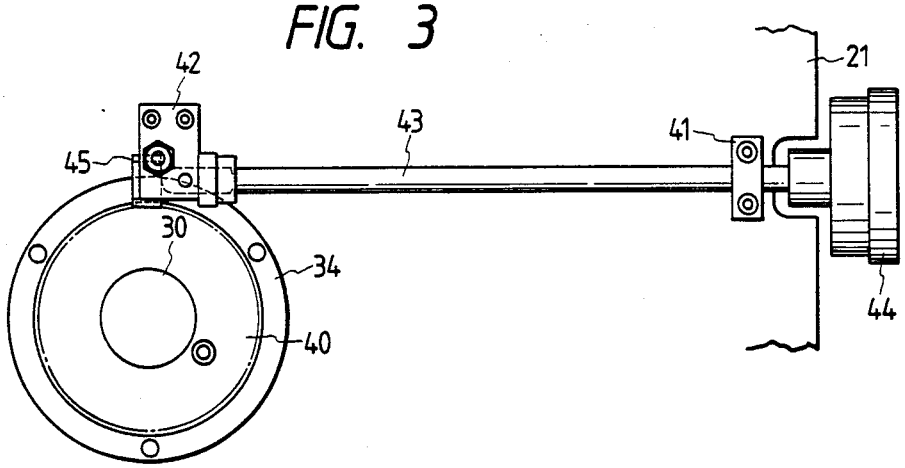
FIG. 3 is a fragmentary front elevational view showing a driving mechanism for moving a paper-feed cylinder in axial direction thereof according to this invention.

A drive mechanism for driving the first helical gear wheel 40 is shown in FIG. 3. The drive mechanism includes an operating shaft 43 rotatably mounted on the outer side of the first frame 21 by a pair of retainers 41, 42 which yet prevent the operation shaft 43 from its axial movement. The operating shaft 43 has one end portion fixedly securing a manipulation dial knob 44 and has another end portion formed with a fourth helical gear 45. The gear 45 is in meshing engagement with the male thread 40*b* of the first helical gear 40. Alternatively, other drive mechanisms may be available such as a plain gear, a chain, a belt, those functioning as power transmission means.

Most importantly the paper feed cylinder 5 is driven by the rotation of the base impression cylinder 3 because of the meshing engagement between the second and third helical gears 64 and 39. Assuming that relative thread phase defined by the helical gears 64 and 39 is changed due to the axial movement of the paper feed cylinder 5, the sheet feed position at which the paper a is to be gripped by the first gripper 11 of the paper feed cylinder 5 is shifted circumferentially with respect to the base impression cylinder 3 by $x\tan\beta$, wherein $\beta$ stands for the twist angle of the second and third helical gears 64,39, and x stands for a moving length of the paper-feed cylinder in its axial direction. Accordingly, image position adjustment in longitudinal direction of a paper to be printed can be achieved.

The outer sleeve 34 also serves as a stop to prevent the paper-feed cylinder 5 from its excessive axial movement. This stop function is achieved by abutment of the helical gear 40 onto the outer sleeve 34. Further, the second frame 21' is formed with a blind bore 21'*b* in which a compression spring 56 is disposed. One end of the spring 56 is secured to a bottom of the bore 21*b'* while another end thereof is secured to a plate 57 fixed to the second inner sleeve 33 by a screw 33A. Therefore, the plate 57 is normally urged away from the frame 21', to thereby absorb axial play of the shaft 30.

With the longitudinal image displacement adjusting apparatus thus constructed, since the phase of the paper-feed cylinder 5 relative to the base impression cylinder 3 is changed by moving the paper-feed cylinder 5 axially via the helical gears, it is possible to correct a longitudinal image displacement in printing easily and precisely. Further, since any longitudinal divergence of the image to be printed in four-color printing can be corrected only by registering the first-color and the second-color images, it is possible to reduce the printing cost and hence the rate of production.

Figure 4:
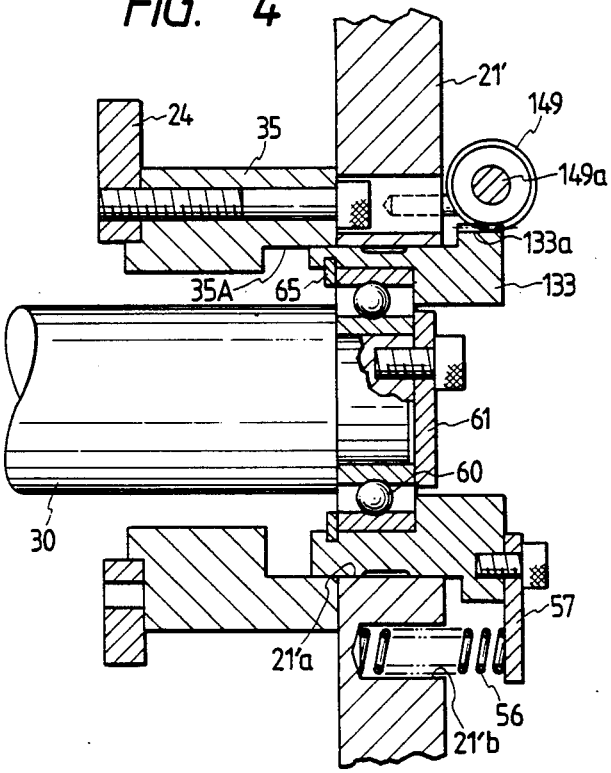
FIG. 4 is a longitudinal cross-sectional view showing a diagonal image adjusting mechanism adapted to be incorporated in the apparatus of FIG. 1.

FIG. 4 illustrates one example of the diagonal image adjusting mechanism. Wherein like parts and components are designated by the same reference numerals and characters as those shown in FIG. 1. The diagonal image adjusting mechanism is provided at the second frame 21' and is incorporated into the above-described longitudinal image displacement adjusting apparatus. In FIG. 4, a second inner sleeve 133 is in an eccentric form with respect to the shaft 30 of the paper-feed cylinder 5 and an outer periphery of the sleeve 133 is formed with a fifth helical gear teeth 133*a* meshing with a sixth helical gear 149. The sixth helical gear 149 is fixed to one end of another operating shaft 149*a* similar to the operating shaft 43 shown in FIG. 3. That is, the other operating shaft 149*a* is rotatably supported to the second frame 21', and has another end provided with a dial knob (not shown) for rotating the sixth helical gear 149. As the eccentric inner sleeve 133 is rotated within the hole 21'*a* of the second frame 21' by the operating shaft& 149*a* , the shaft 30 and hence the paper-feed cylinder 5 is cocked. Namely, angularly moved or twisted relative to the base impression cylinder 3. Accordingly a skew or slant of the image to be printed can be corrected. It goes without saying that the eccentric sleeve 133 is movable in axial direction thereof relative to the hole 21'*a* for also performing image adjustment in the longitudinal direction. For this, the above mentioned holder 35 is formed with a guide recess 35A in alignment with the hole 21'*a*.

Figure 7:
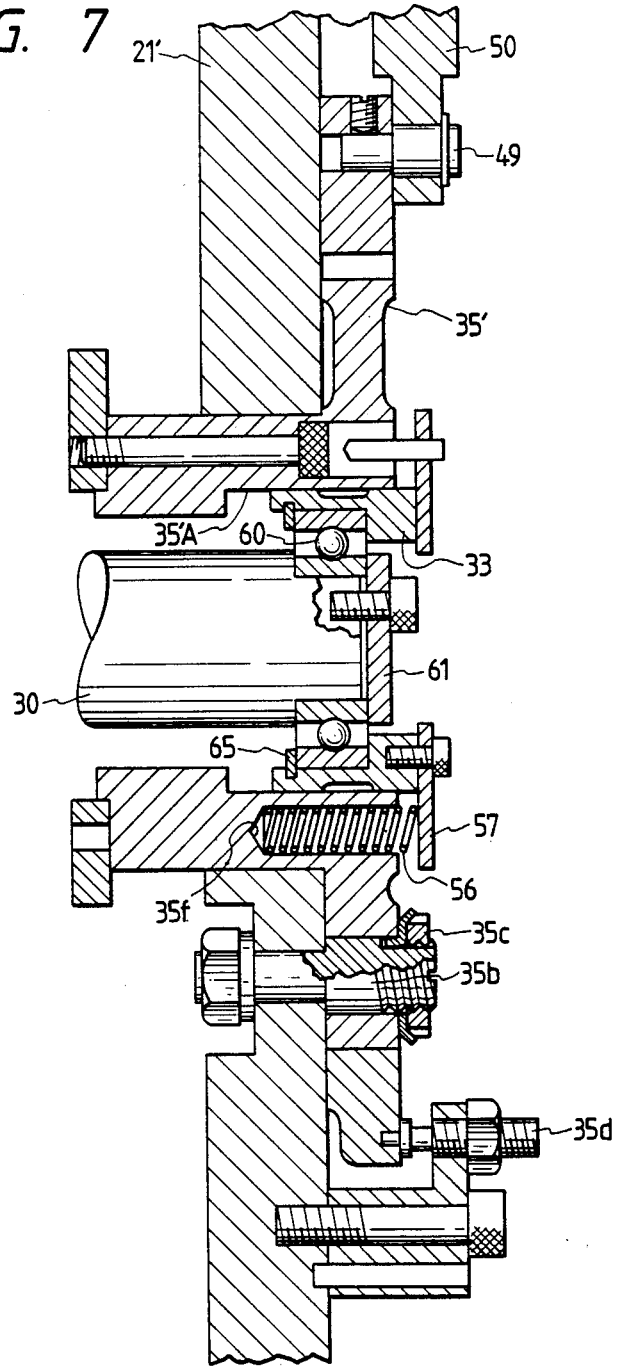
FIG. 7 is a cross-sectional view showing another diagonal image adjusting mechanism adapted to be incorporated in the apparatus of FIG. 1; and, FIG. 8 is a side elevational view of the diagonal image adjusting mechanism shown in FIG. 7.
Figure 8:
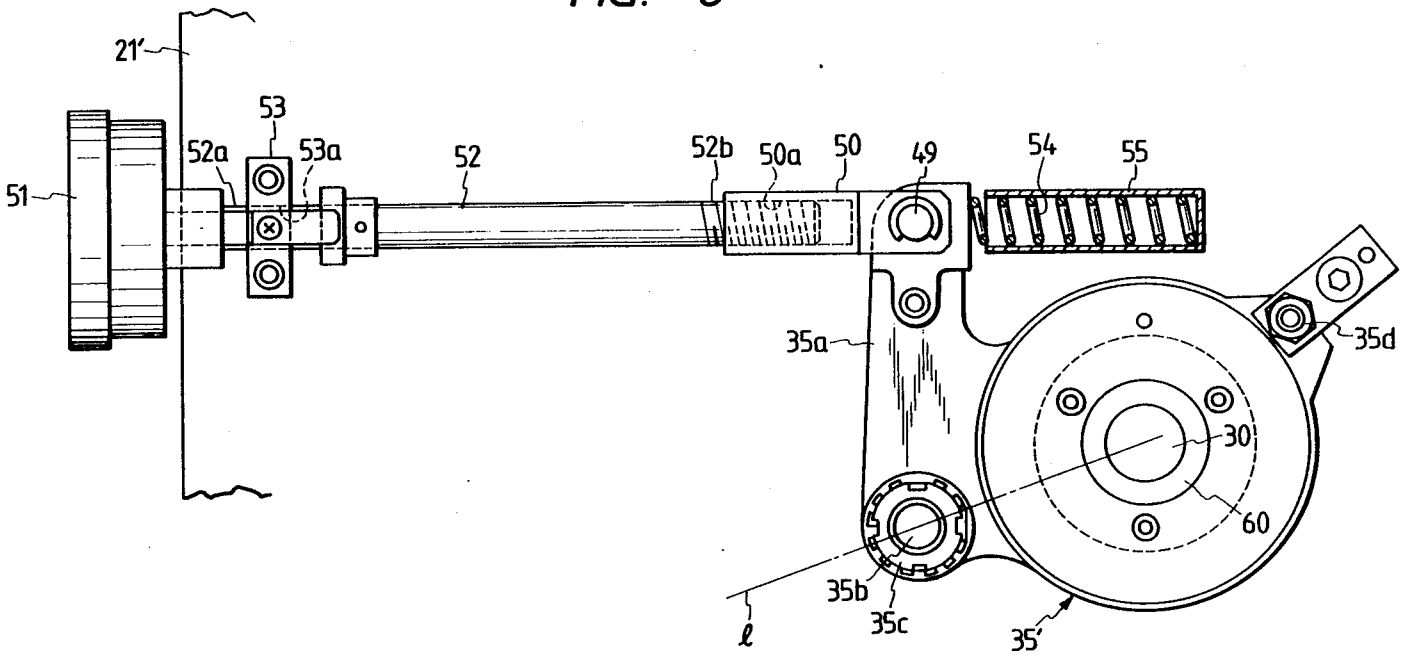

FIGS. 7 and 8 show another example of the diagonal image adjusting mechanism incorporated into the longitudinal image displacement adjusting apparatus according to this invention.

One end of the shaft 30 is supported by the first frame 21 in the manner the same as the construction shown in FIG. 1. On the other hand, the other end portion of the shaft 30 is supported by the second bearing 60 which is supported by a shaft holder 35' through a second inner sleeve 33.

In the illustrated embodiment, the shaft holder 35' is pivotally supported by the second frame 21', so that the paper-feed cylinder 5 can be cocked, namely, the paper feed-cylinder 5 is moved with respect to the base impression cylinder 3. To thereby distort or twist the paper "a". Thus the gripping manner of the second gripper 12 at the base impression cylinder 3 can be changed to regrip the paper "a" in such distorted or twisted posture, thereby enabling adjustment of the relationship between the paper "a" and an image to be printed thereon. For this, a hole 21'*a* is formed at the frame 21' so as to allow the shaft holder 35 to be pivotally movable about a pivot shaft 35b (described later). Therefore, by controlling the dimension of the hole 21'a, rocking movement of the shaft holder 35 is controlled, to thus control cocking amount of the paper-feed cylinder 5 relative to the base impression cylinder 3.

Further, the shaft holder 35' has an inner peripheral surface 35'A functioning as a guide for guiding travel of the inner sleeve 33. That is, since the inner sleeve 33 is provided integral with the second bearing 60 and the other end of the shaft 30, the inner sleeve 33 is slidable on the surface 35'A, when the shaft 30 is moved in axial direction thereof by the operation of the shaft drive means described above. Furthermore, details of bearing retainer 61, a bearing stop 65, a plate 57, a spring 56 are the same as those in the foregoing embodiment, and therefore, further description is negligible. In the embodiment shown in FIG. 4, the blind bore 21'b is formed in the second frame 21'. However in the embodiment shown in FIG. 7, corresponding bore 35f is formed in the shaft holder 35', As shown in FIGS. 7 and 8, the shaft holder 35' has a flange 35a projecting radially outwardly therefrom. At a base end portion of the flange 35a, the shaft holder 35' is pivotally supported on the frame 21' by a pivot shaft 35b implanted on the frame 21'. The pivot shaft 35b is disposed on an imaginary line { (see FIG. 8) connecting between the central axis of the shaft 30 of the paper-feed cylinder 5 and the central axis of the shaft 3a (FIG. 2) of the base impression cylinder 3. A nut 35c is threadingly engaged with the pivot shaft 35b so as to prevent the shaft holder 35' from removing from the frame 21'. Further, a screw bolt 35d is provided to avoid release of the shaft holder 35' from the frame 21'.

At free end portion of the flange 35a, a pin 49 is implanted, and a crevice. 50 is pivotally connected to the pin 49. Thus by turning the shaft holder 35' about the pivot shaft 35b, it is possible to angularly move the second bearing 60 for adjustment of angular position of the shaft 30 of the paper-feed cylinder 5 with respect to the shaft 3a of the base impression cylinder 3.

As shown in FIG. 8, an operating shaft 52 has one end provided with a knob 51 for turning the shaft holder 35'. The operating shaft 52 also has an externally threaded portion (hereinafter also referred to as "first male screw portion") 52a at a position near the knob 52, and another externally threaded portion (hereinafter also referred to as "second male screw portion") 52b at another end portion remote from the knob 52. The frame 21' has shaft retainer 53 having an internally threaded hole (hereinafter also referred to as "first female screw hole") 53a with which the first male screw portion 52a of the operating shaft 52 is threadingly engaged. Further, in FIG. 8, a spring retainer 55 is fixed to the frame 21', and a coil spring 54 is disposed in the retainer 5. The spring 54 serves to normally urge the shaft holder 35' toward the operating shaft 52, thereby preventing any play or rattle of the shaft holder 35'. As the operating shaft 52 is turned in one or another direction by rotating the knob 51, the operating shaft 52 is moved axially forwardly and backwardly with respect to the frame 21' against the biasing force of the coil spring 54. The crevice 50 is formed with an internally threaded hole (hereinafter also referred to as "second female screw hole") 50a extending in axial direction thereof, so that the second male screw portion 52b is threadingly engaged with the second female screw 50a. In response to rotational movement of the operating shaft 52, the crevice 50 is moved axially forwardly and backwardly relative to the operating shaft 52.

Spiral direction of these screws are all the same. However, the first male screw portion 52a and the fist female screw hole 53a have a screw pitch greater than that of the second male screw portion 52b and the second female screw 50a. With this difference of the screw pitch, the relative movement between the crevice 50 and the operating shaft 52 can be reduced, even if the axial displacement of the shaft 52 relative to the frame 21' is large. Thus the angular movement of the shaft holder 35' can be adjusted in a fine and delicate fashion by turning the knob 51.

For example, assuming that the first male screw portion 52a and the first female screw hole 53a have a screw pitch of 2 mm and the second male screw portion 52b and the second female screw hole 50a have a screw pitch of 1 mm, the operating shaft 52 can be axially moved by 2 mm upon a single complete rotation of the shaft 52. Meanwhile the crevice 50 can be axially moved only by 1 mm, cancelling the movement of the operating shaft 52 by 1 mm. As a result. the shaft holder 35' can be angularly moved about the pivot shaft 35b by only a small distance.

Although in the above described embodiment the operating shaft 52 is threadingly engaged with both the holder 53 of the frame 21' and the crevice 50, the present invention is not limited to such structure. For example, the operating shaft 52 can be only engaged with one of the holder 53 and the crevice 50, with the remaining one of the crevice 50 and the holder 53 being only provided at a given position. For example, if the operating shaft 50 is only threadingly engaged with the crevice 50, the holder 53 merely allow the shaft 52 to rotatably pass therethrough. Alternatively, if the operating shaft 50 is only threadingly engaged with the holder 53, the crevice 50 allows the shaft 52 to rotatably receive therein.

In view of the foregoing, according to the present invention, even if the master plate contains minor error or the master plate is erroneously attached to the plate cylinder. The image adjustment in longitudinal or vertical direction of the paper can be easily performed by merely moving the paper feed cylinder in axial direction thereof so as to change phase of the paper feed cylinder 5 relative to the base impression cylinder 3, to thereby change paper gripping position. Therefore, in case of four color printing, only first and second color images are required to be adjusted. This is in high contrast to the conventional apparatus in which first. and second color images must be adjusted and thereafter, third and fourth color images must be adjusted with respect to the identical paper.

Further, according to the present invention, such image ajustment can be easily operated by the simple construction within a minimized time, and such adjustment is achievable even during the printing operation. And in case of the monochromatic printing, the paper position is controlled relative to an image on the master plate by operating the paper feed cylinder. Therefore, it is unnecessary to adjust the plate cylinder.

Furthermore, the present invention can incorporate the screw correcting mechanism as shown in FIGS. 4 and 7. When the master plate is erroneously assembled to the plate cylinder, for example, when the plate is slantingly attached to the plate cylinder, a paper can be easily distorted in conformance with the erroneous plate. That is, the eccentric sleeve 133 is rotatable so that the shaft 30 of the paper feed cylinder can be oriented at a proper angle with respect to the base impression cylinder. Alternatively, the shaft holder 35' is pivotally moved about the pivot shaft **35*b* positioned on the imaginary line connecting between the central axes of the base impression cylinder 3 and the paper feed cylinder 5, by the rotational operation of the operation shaft 52. By this pivotal movement of the shaft holder 35', the paper-feed cylinder 5 is subjected to cocking with respect to the base impression cylinder 3, to thereby orient the paper in a proper direction. As a result, the second gripper 12 can grip the thus oriented paper. Such cocking is achievable with minimized displacement of the paper-feed cylinder 5 with respect to the base-impression cylinder because of the pivotal movement of the shaft holder 35'** abut the pivot shaft positioned at the imaginary line.

Although various minor modifications may be suggested by those versed in the art, it should be understood that we wish to embody within the scope of the patent granted hereon, all such embodiments as reasonably and properly come with the scope of out contribution to the art.

What is claimed is:

1. An image adjusting apparatus for adjusting a paper position with respect to an original image in a multicolor printing machine, comprising:

a pair of first and second frames;

an impression cylinder having a first shaft rotatably supported on said first and second frames;

plate cylinders mounted between said frames for cooperating with said impression cylinder;

a paper supply table;

a paper-feed cylinder for feeding said paper to said impression cylinder, said paper-feed cylinder being secured to a second shaft for rotation therewith;

means for feeding paper from said paper supply table to said paper-feed cylinder;

means for mounting said second shaft between said first and second frames for rotational and axially slidable movement;

a moving means for moving said second shaft in an axial direction thereof, said moving means being operably connected to said second shaft of said paper-feed cylinder;

means for drivingly connecting said first and second shafts for thus rotating said impression cylinder and said paper-feed cylinder in synchronous relationship;

a phase changing mechanism provided between said first and second shafts, said phase changing mechanism having means for rotating said second shaft relative to said first shaft in response to axial movement of said second shaft by said moving means so as to change a peripheral position of said paper-feed cylinder relative to said impression cylinder, whereby longitudinal image displacement relative to said paper is adjustable.

2. The image adjusting apparatus according to claim 1, wherein said moving means comprises:

a first inner sleeve for rotatably supporting said one end of said second shaft, yet preventing the same from its axial displacement with respect thereto;

a second inner sleeve for rotatably supporting said another end of said second shaft, said second inner sleeve being slidable with respect to said second frame;

first outer sleeve disposed over said first inner sleeve and supported by said first frame, said first inner sleeve being slidable with respect to said first outer sleeve;

a threading means provided at said first inner and outer sleeves to allow said first inner sleeve to rotationally move in axial direction thereof;

a first helical gear connected to said first inner sleeve; and, a second helical gear engageable with said first helical gear for rotating said first helical gear.

3. The image adjusting apparatus according to claim 2, wherein said moving means further comprises:

an operating rod rotatably supported to said first frame, said rod having one and another ends; and a manipulation dial knob connected to said one end of said operating rod; said second helical gear being provided at said other end of said rod.

4. The image adjusting apparatus according to claim 2, wherein said phase changing mechanism comprises a third helical gear connected to said impression cylinder and rotatable by a rotation of said impression cylinder, and a fourth helical gear connected to said second shaft; said fourth helical gear being in meshing engagement with said third helical gear.

5. The image adjusting apparatus according to claim 2 further comprising: a diagonal image adjusting mechanism provided at a side of said second frame.

6. The image adjusting apparatus according to claim 5 wherein said diagonal image adjusting mechanism comprises;

said second inner sleeve being at eccentrical sleeve for eccentrically supporting said another end of said second shaft, said eccentrical sleeve being rotatably and axially slidably supported by said second frame, said eccentrical sleeve being formed with a fifth helical gear teeth;

a sixth helical gear meshingly engaged with said fifth helical gear, said sixth helical gear being rotatable to rotate said fifth helical gear, so that orientation of said second shaft with respect to said impression cylinder is changeable.

7. The image adjusting apparatus according to claim 6, further comprising;

an operation shaft rotatably supported on said second frame, said operation shaft having one end and another end, a knob connected to said one end of said operation shaft, said sixth helical gear being connected to said another end of said operation shaft.

8. The image adjusting apparatus according to claim 5, wherein said diagonal image adjusting mechanism further comprises:

a shaft holder for holding said second inner sleeve, said shaft holder being supported to said second frame, said shaft holder having first and second end portions, said shaft holder being pivotally supported to said frame at said first end portion, and being formed with a recessed portion for guide sliding movement of said second inner sleeve in axial direction thereof;

a pivot shaft& for pivotally supporting said first end portion of said shaft holder; said pivot shaft extending from said second frame and disposed on an imaginary line connecting between axes of said first and second shafts;

an operating shaft rotatably supported on said second frame and operably connected to said second end portion of said shaft holder; and, means for pivoting said shaft holder about said pivot shaft in response to rotation of said operating shaft, said means being disposed between said operating shaft and at least one of said second frame and said shaft holder.

9. The image adjusting apparatus according to claim 8 wherein said for pivoting comprises a first threading portion provided at said second frame and a second threading portion formed over one end portion of said operating shaft, said first threading portion being threadingly engaged with said second threading portion.

10. The image adjusting apparatus as defined in claim 9, wherein said means for pivoting comprises a crevice connected to said second end portion of said shaft holder, said crevice being formed with a third threading portion; and a fourth threading portion formed over another end portion of said operating shaft, said third threading portion being threadingly engaged with said fourth threading portion.

11. The image adjusting apparatus as defined in claim 9, wherein said means for pivoting further comprises a crevice connected to said second end portion of said shaft holder, said crevice being formed with a third threading portion; and a fourth threading portion formed over another end portion of said operating shaft, said first and second threading portion having spiral pitches twice as large as those of said third and fourth threading portion.

12. The image adjusting apparatus as defined in claim 9, wherein said means for pivoting further comprises an operation knob connected to one end of said operating shaft, said second threading portion being positioned adjacent said operation knob.

13. The image adjusting apparatus as defined in claim 10, wherein said means for pivoting further complies an operation knob connected to one end of said operating shaft, said fourth threading portion being positioned remote from said operation knob.

14. The image adjusting apparatus as defined in claim 11, wherein said means for pivoting further complies an operation knob connected to one end of said operating shaft, said fourth threading portion being positioned remote from said operation knob.

* * * * *